United States Patent [19]

Kosaka et al.

[11] 4,273,602

[45] Jun. 16, 1981

[54] HEAT-SENSITIVE RECORDING MATERIAL

[75] Inventors: Takao Kosaka; Yukio Tahara, both of Takasago, Japan

[73] Assignee: Mitsubishi Paper Mills, Ltd., Tokyo, Japan

[21] Appl. No.: 10,043

[22] Filed: Feb. 6, 1979

[30] Foreign Application Priority Data

Feb. 7, 1978 [JP] Japan ..... 53-12637

[51] Int. Cl.[3] ..... B41M 5/18

[52] U.S. Cl. ..... 156/234; 156/240; 282/27.5; 346/135.1; 427/150; 427/151; 427/153; 428/200; 428/207; 428/211; 428/488; 428/913; 428/914

[58] Field of Search ..... 106/21, 31; 282/27.5; 427/148, 150, 151, 153; 428/488, 537, 913, 914, 200, 207, 211; 156/234, 240, 277; 346/135.1

[56] References Cited

U.S. PATENT DOCUMENTS

| | | | |
|---|---|---|---|
| 3,988,501 | 10/1976 | Knirsch et al. | 428/913 X |
| 4,032,690 | 6/1977 | Kohmura et al. | 428/488 X |
| 4,054,718 | 10/1977 | Garner et al. | 282/27.5 X |
| 4,126,334 | 11/1978 | Malderghem | 282/27.5 |

*Primary Examiner*—Bruce H. Hess

[57] ABSTRACT

A heat-sensitive recording material is disclosed which comprises a support sheet of 5–40μ in thickness having thereon a heat-sensitive transfer layer containing a phenolic material, a colorless or pale-colored chromogenic material which forms a color with said phenolic material upon application of heat and a heat fusible material having a melting point of 40°–150° C. and an image receiving sheet superposed on the surface of said layer which are made into one integral sheet by pressing. Using this recording material, sufficiently high density of record can be obtained even by low heat energy, and the background (non-record portion) forms substantially no color to result in high contrast of record.

11 Claims, 8 Drawing Figures

AT HEAT IMPRINTING

AFTER HEAT IMPRINTING

AT HEAT IMPRINTING

AFTER HEAT IMPRINTING

AT HEAT IMPRINTING

AFTER HEAT IMPRINTING

AT HEAT IMPRINTING

AFTER HEAT IMPRINTING

HEAT-SENSITIVE RECORDING MATERIAL

BACKGROUND OF THE INVENTION

This invention relates to a heat-sensitive recording material and more particularly it relates to a heat-sensitive recording material which comprises a support sheet of 5–40μ in thickness having thereon a heat-sensitive transfer layer containing a phenolic material, a colorless or pale-colored chromogenic material which reacts with said phenolic material to form color upon application of heat and a heat fusible material having a melting point of 40°–150° C. and an image receiving sheet superposed on the surface of said layer which are made into one integral sheet by pressing. According to this invention there is provided a method for obtaining a fixed heat-sensitive recorded image which comprises heating said recording material from the side of said support sheet of 5–40μ in thickness by a thermal pen, a thermal head or infra-red radiation and thereafter separating the two sheets to transfer the heat-imprinted portion to the image receiving sheet. Heat-sensitive recording sheets which use a chromogenic material such as Crystal Violet Lactone and a phenolic material such as bisphenol A in combination are disclosed in, for example, Japanese Patent After-examination Publication (KOKOKU) No. 14039/70. Such heat-sensitive recording sheets are now widely used as business copying papers, recording papers of various recorders, electrocardiographs, in desk-top calculator, terminals of computer, facsimiles, etc.

However, when these heat-sensitive recording sheets are carelessly heated after imprinting, it is liable to occur that the background of the sheet forms color and the imprinted letters become unreadable or are altered. Thus, solution of such defects has been strongly desired. Japanese Patent After-examination Publication (KOKOKU) No. 2534/76 and Japanese Patent Pre-examination Publication (KOKAI) No. 22134/72 proposed heat-sensitive recording methods which overcome said defects, according to which two heat-sensitive components are on separate sheets and letters are imprinted in such state that the coating layers are in contact with each other. Furthermore, Japanese Patent After-examination Publication (KOKOKU) No. 43788/76 proposed a method according to which colored dyes or pigments are contained in a heat-sensitive transfer layer and letters are imprinted thereon in such state wherein the heat-sensitive transfer layer and an ordinary paper are superposed. However, when the two sheets are merely superposed as in these methods, the two sheets are liable to shift in relation to each other or thermal conductivity is very low and sufficient recording density cannot be obtained under such limited heat energies as thermal printers, thermal facsimiles, and the like.

Furthermore, Japanese Patent Pre-examination Publications (KOKAI) No. 45938/72 and No. 48137/73 and Japanese Patent After-examination Publication (KOKOKU) No. 29949/76 proposed methods according to which a heat-sensitive transfer layer is formed from waxes or resins of low molecular weight, colored dyes are dissolved or dispersed in said layer and this layer is allowed to contact an ordinary paper. However, in this case a part of the layer is apt to transfer to the ordinary paper to cause staining of background and to decrease contrast between letters and the background. Thus, the recorded letters cannot be easily read. Moreover, appearance of the letters is not good and commercial value is greatly reduced.

SUMMARY OF THE INVENTION

As the result of the inventors' intensive research, it has been found that when a heat-sensitive transfer layer containing an ordinarily colorless or pale-colored chromogenic material, a phenolic material which causes color formation of said chromogenic material upon application of heat and a heat fusible material having a melting point of 40°–150° C. and having an adhesives property, a property as a transferring agent for transferring a heat-imprinted portion to an ordinary paper upon application of heat and a property as an agent for increasing color forming sensitivity of said chromogenic material which makes possible color formation of the chromogenic material even under low heat energy is coated on a support sheet of 5–40μ in thickness and this heat-sensitive transfer layer is allowed to contact an ordinary paper and these two sheets are bonded under pressure into one integral sheet and when thus obtained recording material is heat-imprinted with letters from the side of the support sheet of 5–40μ in thickness and the heat-imprinted portions of the heat-sensitive transfer layer is transferred to the ordinary paper, sufficiently high record density can be obtained even under low heat energy conditions. There also occurs no apparent fogging of the background and even if the recording material is inadvertently heated, it forms only a little color which has substantially no effect on contrast of letters and no alteration of letters occurs.

Furthermore, transfer to an ordinary paper has practically no problems, but it has been also found that when an image receiving sheet having a layer of image receiving sheet having a layer of receiving agent having tackiness upon application of heat is used, a further complete image-fixed paper having no stain in the background and high stability of the recorded portions can be obtained when the two sheets are separated.

It is also strongly desired to obtain two recorded papers by one recording operation. According to the heat-sensitive recording material of this invention, when a transparent or translucent support sheet for the heat-sensitive transfer layer is used, a part of the imprinted portions of the heat-sensitive transfer layer which remains on the support sheet can be read through the sheet and so such recording material can be used for obtaining two recorded papers. Even when an opaque support sheet is used, such recording material can also be used for obtaining two recorded papers of a heat-sensitive chromogenic layer comprising a phenolic material and a colorless or pale-colored chromogenic material which reacts with said phenolic material upon application of heat to form a color is provided also on the surface of the support sheet which is opposite to the heat-sensitive transfer layer.

DESCRIPTION OF THE INVENTION AND THE PREFERRED EMBODIMENTS

First of all, this invention will be explained with reference to the accompanying drawings.

Figure 1A:
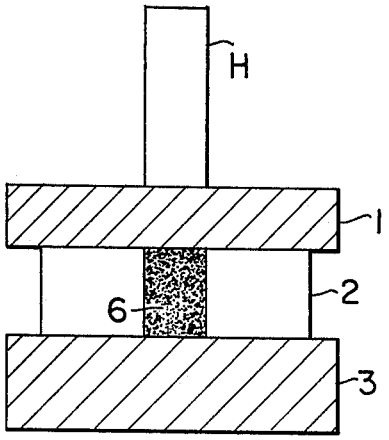
FIG. 1*a* to FIG. 4*b* schematically show embodiments of the heat-sensitive recording material of this invention.
Figure 1B:
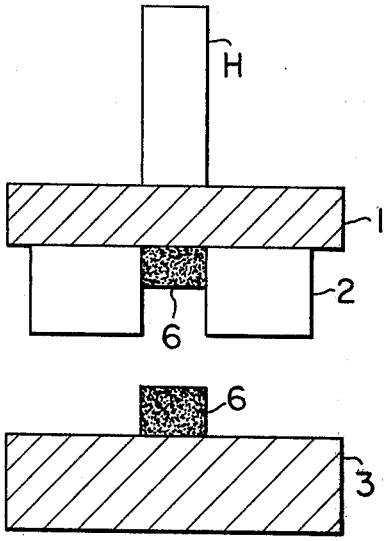
Figure 2A:
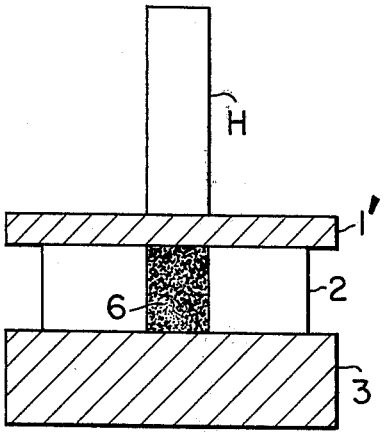
Figure 2B:
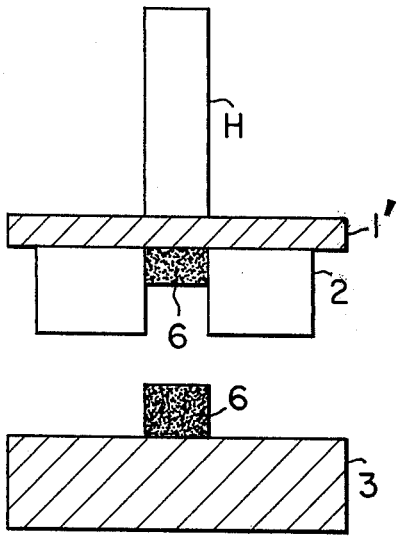
Figure 3A:
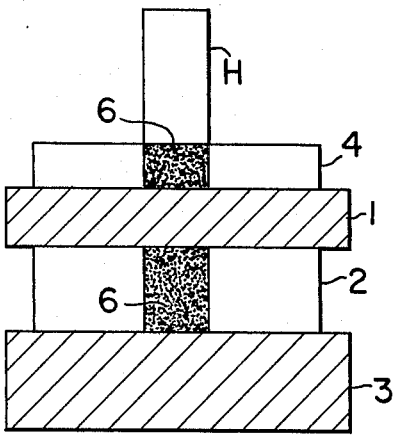
Figure 3B:
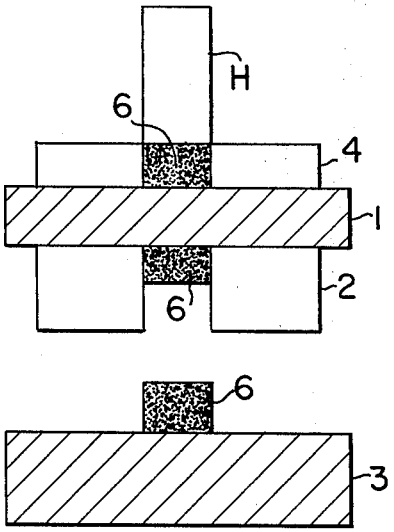
Figure 4A:
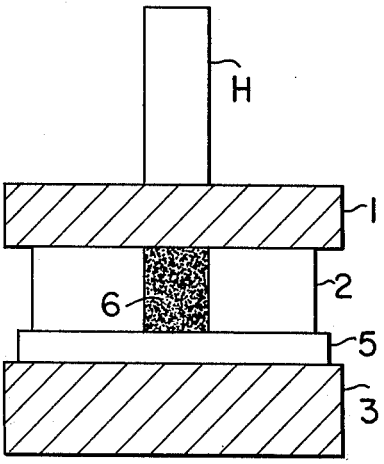
Figure 4B:
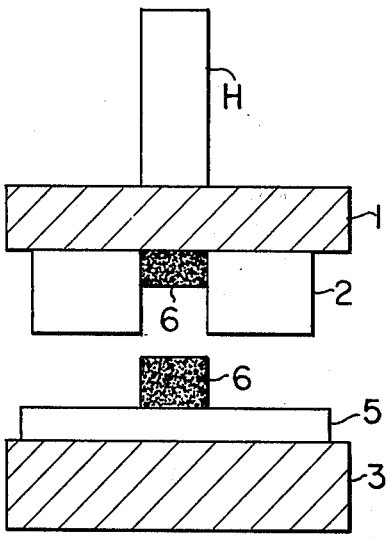

FIG. 1*a*, FIG. 2*a*, FIG. 3*a* and FIG. 4*a* show an enlarged cross-section of a portion of the recording material at the time of application of heat and FIG. 1*b*, FIG. 2*b*, FIG. 3*b* and FIG. 4*b* show the same recording material after separating the two sheets. That is, in FIG. 1*a*, *and* FIG. 1*b*, a heat-sensitive transfer layer is coated on an ordinary high quality paper and said heat-sensitive transfer layer is bonded to an ordinary paper under pressure. After imprinting with a thermal head, the two papers are separated to transfer the imprinted portion of the heat-sensitive transfer layer to the ordinary paper to obtain a fixed image recorded paper. FIG. 2*a* and FIG. 2*b* show the case where a transparent or translucent support is used in the structure of FIG. 1*a*. In this case, the lower sheet is the image-fixing paper and the upper sheet is a recording sheet having thereon a record which can be read through the support. FIG. 3*a* and FIG. 3*b* show such structure as a usual heat-sensitive layer is coated on one surface of an ordinary high quality paper and a heat-sensitive transfer layer on the opposite surface of the high quality paper and said heat-sensitive transfer layer is bonded to an ordinary paper. In this case, too, the lower sheet is the recorded image-fixed paper and the upper sheet is an ordinary heat-sensitive image recorded sheet. FIG. 4*a* and FIG. 4*b* show the case where an image receiving layer is coated on an ordinary paper. In these FIG. 1*a*–4*b*, H indicates a thermal head, 1 is a support of 5–40μ in thickness, 1' is a transparent or translucent support of 5–40μ in thickness, 2 is a heat-sensitive transfer layer, 3 is an ordinary paper, 4 is an ordinary heat-sensitive layer, 5 is a receiving layer and 6 is a heat-impressed portion.

Representative examples of the colorless or pale-colored chromogenic materials used in this invention which can not be considered to their limiting this invention are as follows:

Crystal Violet Lactone, Malachite Green Lactone, 3,3-bis(paradimethylaminophenyl)-6-aminophthalide, 3,3-bis(p-dimethylaminophenyl)-6-(p-toluenesulfoamide) phthalide, 3-diethylamino-7-(N-methylanilino) fluorane, 3-diethylamino-7-(N-methyl-p-toluidino) fluorane, 3-dimethylamino-6-methoxyfluorane, 3-diehtylamino-7-chlorofluorane, 3-diethylamino-6-methyl-7-chlorofluorane, 3-diethylamino-7-phenylfluorane, 3-morpholino-5,6-benzofluorane, 3-diethylamino-5-methyl-7-dibenzylaminofluorane, 3-diethylamino-7-dibenzylaminofluorane, 3-diethylamino-7,8-benzofluorane, 3-cyclohexylamino-6-chlorofluorane, benzo-β-naphthospiropyran, 3-N-ethyl-tolyamino-6-methyl-7-anilinofluorane, 3-diethylamino-7-(3-trifluoromethylphenyl) aminofluorane, 3-pyrrolidino-6-methyl-7-anilinofluorane, 3-piperidino-6-methyl-7- anilinofluorane, etc.

The phenolic materials used in this invention are those which have the property of being liquified or vaporized at a temperature of higher than normal-ambient temperature, preferably higher than 70° C. and reacting with said chromogenic materials to cause color formation of these materials. Examples of the phenolic materials are as follows: 4,4'-isopropylidene diphenol, 4,4'-isopropylidene bis(2-chlorophenol), 4,4'-isopropylidene bis(2-t-butylphenol), 4,4'-sec-butylidenediphenol, 4,4'-(1-methylnormalhexylidene)diphenol, 4-phenylphenol, 4-hydroxybenzoate, phenyl-4-hydroxybenzoate, 4-hydroxyacetophenone, 4,4'-cyclohexylidenediphenol, 4,4'-cyclohexylidene bis(2-methylphenol), 4,4'-benzylidene-diphenol, 4,4'-thiobis(6-t-butyl-3-methylphenol), novolak type phenol resins, halogenated novolak type phenol resins, β-naphthol, β-naphthol, etc. Among these materials, those which have at least 2 hydroxyl groups in one molecule are especially preferred.

The chromogenic material and the phenolic material may be used in such amounts as the chromogenic material: the phenolic material = 1:1–10, preferably 1:2–8.

Examples of the heat fusible materials having a melting point of 40°–150° C. used in this invention are as follows:

(1) Those which have the property as an agent for increasing sensitivity of the chromogenic material for color formation which can bring about the color formation of the chromogenic materials even by low heat energy: Waxes such as paraffin wax, synthethic waxes, higher fatty acid amides, etc. whch are mentioned in Japanese Patent Pre-examination Publication (KOKAI) No. 19231/73, urea, phthalic anhydride, acetoanilide, etc. which are mentioned in Japanese Patent After-examination Publication (KOKOKU) No. 4160/68; nitrogen-containing compounds mentioned in Japanese Patent Pre-examination Publication (KOKAI) No. 34842/74; and acetoacetic anilides mentioned in Japanese Patent Pre-examination Publication (KOKAI) No. 106740/77.

(2) Those which have the property of bonding the two sheets: Waxes which are solid at normal-ambient temperature such as paraffin wax, polyolefin wax, micro wax, fatty acid amide, etc. If necessary, pressure-sensitive adhesives such as rubbers, petroleum resins, latex may be used so long as they do not prevent separation of two sheets after recording.

(3) Those which have the property of transferring the portions of heat-impressed transfer layer: Paraffins, microwaxes, ceresin, carnauba wax, montan wax, polyethylene wax, synthetic waxes, polyolefins, solid fatty acids, solid amides, hydrogenated castor waxes, etc. As resins, there are vinyl chloride, vinyl acetate copolymer, polyvinyl butyral, vinylidene chloride, cellulose resins, chlorinated rubbers, etc.

These heat fusible materials may be used in a suitable amount of 30–300%, preferably 50–200% by weight of the phenolic material.

The heat fusible materials having a melting point of 40°–150° C. are required to have the three properties mentioned above. If one heat fusible material has these three properties, such material may be used alone, but preferably two or more of the heat fusible materials are jointly used to provide all of said three properties. The melting point of 40°–150° C. is necessary for lowering the color forming temperature and obtaining a sharp recorded image.

Binders should be used in the necessary lowest amount considering the adhesion properties of the two sheets and transferability of the heat-imprinted transfer layer and preferably in an amount of up to 20% of the total solid matter. Examples of suitable binders are generally known water soluble resins such as polyvinyl alcohol, methyl cellulose, hydroxyethyl cellulose, gum arabic, carboxymethyl cellulose, starch, gelatin, casein, styrene-maleic anhydride copolymer, polyacrylates, polyacrylic acid copolymer, aqueous emulsion such as styrene-butadiene latex, etc. When the medium is a solvent, solvent type resins such as terpene resin, petroleum resin, cyclized rubber, etc. may be used as a binder.

The support sheet of 5–40μ in thickness is preferably of good thermal conductivity and examples thereof are papers such as glassine paper, parchment paper, etc. and plastic films such as cellophane, cellulose acetate, saran, polycarbonates, polyesters. When heat-sensitive chromogenic layer is coated for obtaining two chromogenic papers using an opaque high quality paper as a support sheet, the following combination may be suitably chosen depending on the desired use.

(1) Combination of ferric esters of long chain fatty acids such as ferric stearate, ferric behenate with phenols such as gallic acid, methyl gallate, lauryl gallate, protocatechuic acid, methyl protocatechuate, 3,4-dihydroxybenzophenone.

(2) Combination of metallic esters of long chain fatty acids such as cupric behenate with metallic chelating agents such as diphenylcarbazide.

(3) Phenols and some photochromic benzoindolinospiropyran compounds.

(4) Combination of leuco dyes such as Crystal Violet Lactone with phenols.

The thickness of 5–40$\mu$ is necessary for increasing thermal conductivity to improve density of imprinted image in the lower receiving sheet.

The support sheet is allowed to contact with and be bonded to an ordinary image receiving sheet such as ordinary papers, synthetic papers, plastic films, etc. to obtain an imprinting transfer type heat-sensitive recording material. Furthermore, it has been found that shelf stability of the image receiving sheet to which the imprinted portion has been transferred can be improved by providing a layer containing a receiving agent having tackiness upon application of heat on the image receiving sheet. This is because since the heat-imprinted portion is firmly fixed on the image receiving sheet due to the tackiness of the receiving agent the difference in appearance between the transferred portion and the untransferred portion is very clear and stability of the imprinted portion is improved. Examples of the receiving agent are paraffin, microwax, carnauba wax, synthetic waxes, polyolefins, polyethylene wax, fatty acid amides, acrylic resins, rubbers such as natural rubber, polyisobutylene, butadiene rubber, styrene-butadiene rubber, etc. polyvinyl chloride and copolymer thereof, vinylidene chloride copolymer, polyvinyl acetate and copolymer thereof, polymethacrylate, ethylene copolymers such as ethylene-vinyl acetate, ethylene-acrylate, etc., polyvinyl ethers, polyvinyl butyral, polyesters, nylon, rosin modified maleic acid resins, rosin modified phenol resins, various plasticizers, low molecule compounds having the similar effects, etc. Besides, any materials which provide tackiness upon application of heat may be used. Synthetic papers usually have thermoplastic materials on their surface, which fully satisfy the requirements as an image receiving sheet.

The coated sheet in this invention can be obtained in the following manner. The chromogenic material and the phenolic material are dispersed, separately. In this case, the dispersion is preferably conducted in such a manner that the materials are ground as small as possible, specifically into particles of several microns in a ball mill and the like. Furthermore, if necessary, dispersants, activators, etc. may be used as grinding assistant. The heat fusible material may be ground like the chromogenic material and the phenolic material or may be used as emulsion. Besides, brightners and fillers such as talc, clay, etc. are added and furthermore, if necessary, said binders are added. These three components are mixed and coated on a support and dried at relatively low temperatures. When two image recorded papers are produced using an opaque support, the heat-sensitive layer can be coated on the surface of the support opposite to the heat-sensitive transfer layer and dried in the same manner as mentioned above. Thus obtained heat-sensitive sheet and an ordinary paper are put together so that the heat-sensitive transfer layer contacts with the ordinary paper and these are bonded by application of pressure to obtain the recording sheet of this invention. The application of pressure can be conducted by various methods, e.g., by passing it through super calenders, machine calenders, gloss calenders, by utilizing the nip of a laminater or by merely passing it between two rubber rolls under pressure, but they do not limit this invention.

The following examples further illustrates the invention.

EXAMPLE 1

| | | |
|---|---|---|
| Liquid A | Crystal Violet Lactone | 1 part by weight |
| | 5% Hydroxyethyl cellulose | 5 parts by weight |
| Liquid B | Bisphenol A | 1 part by weight |
| | 5% Hydroxyethyl cellulose | 5 parts by weight |
| Liquid C | Fatty Acid AMIDE P (palmitic acid amide produced by Nitto Chemical K.K.) | 1 part by weight |
| | 5% Hydroxyethyl cellulose | 5 parts by weight |

The above three components were separately ground in a ball mill for 2 days and they were mixed with agitation at the ratio of A:B:C=1:5:10. The mixture was coated on a typing paper of 25 g/m$^2$ at a dry coating amount of 10 g/m$^2$ and was dried at a relatively low temperature to obtain a heat-sensitive transfer paper. This transfer paper was superposed on a high quality paper of 40 g/m$^2$ in such a manner that the heat-sensitive transfer layer on said transfer paper was in contact with said high quality paper and they were bonded under 10 kg/cm$^2$ by a super calender. The resultant recording sheet was imprinted using a TOSHIBA HEAT-SENSITIVE FAX KB-500 (main scanning speed . . . 300 lpm and voltage of recording head . . . 20.9 V) which is a commercially available heat-sensitive facsimile machine and then the two papers were separated. The density of the image receiving paper was measured by a photoelectric densitometer PDA-30 of Konishiroku K. K. and a density of 0.6 in the recorded portion and that of 0.08 in the background were obtained. When the background was reheated, the density of the background was 0.3. This means that there was obtained a recording sheet which formed substantially no color in the background even after being reheated and on which a recorded image could be fixed.

EXAMPLE 2

To a mixed liquid as prepared in Example 1 but of A:B:C=1:5:3 was added 3 parts by weight of an emulsion of micro wax and they were mixed under agitation. The mixture was coated on a glassine paper of 27.0 g/m$^2$ and a heat-sensitive recording sheet was produced and was imprinted in the same manner as in Example 1. The color density of the recorded portion of the upper sheet was 0.7 and the density of the recorded portion of the lower sheet was 0.7. The density of color formed on the background of the lower sheet after reheating was 0.25. The upper sheet was an ordinary heat-sensitive image recorded sheet and the lower sheet was a recording sheet on which the image was fixed.

EXAMPLE 3

| | | |
|---|---|---|
| Liquid D | 3-Pyrrolidino-6-methyl-7-anilinofluorane | 1 part by weight |
| | 5% Hydroxyethyl cellulose | 5 parts by weight |

The above liquid was ground in a ball mill for 12 hours.

Example 2 was repeated using liquid D in place of liquid A. The density of the recorded portion of the upper sheet was 0.6 and the density of the recorded portion of the lower sheet was 0.65. The density of color formed on the background of the lower sheet after reheating was 0.25. Thus, two sheets on which the recorded portion was colored in black were obtained and the lower sheet was a recording sheet on which the image was fixed.

EXAMPLE 4

| | | |
|---|---|---|
| Liquid E | TAMANORU 135 (Rosin modified phenol resin produced by Arakawa Rinsan K.K.) | 1 part by weight |
| | 5% Hydroxyethyl cellulose | 5 parts by weight |

This liquid was ground in a ball mill for 24 hours and was coated on a high quality paper of 40 g/m$^2$ at a dry coating amount of 2 g/m$^2$ and dried. Example 2 was repeated except that said paper was used as the image receiving sheet. The density of the recorded portion of the upper sheet was 0.7 and that of the lower sheet was 0.75. The density of color formed on the background of the lower sheet after reheating was 0.2. As in Example 2, two sheets having colored image thereon were obtained. The lower sheet was a recording sheet on which the image was completely fixed.

EXAMPLE 5

Example 4 was repeated using ZAIKTHENE A (ammonium salt of ethylene-acrylic acid copolymer produced by Seitetsu Kagaku K. K.) in place of liquid E. The density of the recorded portion on the upper sheet was 0.7 and that on the lower sheet was 0.75. The density of color formed on the background of the lower sheet after reheating was 0.2.

EXAMPLE 6

| | | |
|---|---|---|
| Liquid F | Fatty Acid Amide S (Stearic acid amide produced by Nitto Chemical K.K.) | 1 part by weight |
| | 5% Hydroxyethyl cellulose | 5 parts by weight |

The above liquid F was ground by ball mill for 24 hours.

| | | |
|---|---|---|
| Liquid G | Light calcium carbonate | 1 part by weight |
| | 5% Sodium hexametaphosphate (dispersant) | 2 parts by weight |
| | Water | 5 parts by weight |

The above liquid G was fully agitated and dispersed by an agitator.

Liquids A and B in Example 1, liquid F and liquid G were mixed with agitation at the ratio of A:B:F:G=1:5:3:5. The resultant mixture was coated on a typing paper of 25 g/m$^2$ at a dry amount of 8 g/m$^2$ and dried and the heat-sensitive transfer layer of Example 2 was coated on another surface of the typing paper. Imprinting was carried out in the same manner. The density of the recorded portion of the upper sheet was 0.9 and that of the lower sheet was 0.7. The density of color formed on the background after reheating was 0.25. The upper sheet was an ordinary heat-sensitive recording sheet and the lower sheet was a recording sheet on which the recorded portion was fixed.

EXAMPLE 7

The heat-sensitive transfer paper obtained in Example 1 was put together with Peachcoat (a synthetic paper of styrene base, WG-110 produced by Nisshin Spinning Co., Ltd.) in such a manner that the heat-sensitive transfer layer of said transfer paper was in contact with said Peachcoat and they were bonded under 10 kg/cm$^2$ by a super calender. Thus obtained recording sheet was imprinted using TOSHIBA HEAT-SENSITIVE FAX KB-500 which is a commercially available heat-sensitive facsimile machine and then the two papers were separated. The density of the image receiving sheet was measured by a photoelectric densitometer PDA-30 of Konishiroku K. K. and a density of 0.6 in the recorded portion. When the background was heated again the density of the background was 0.25. This image receiving sheet was a recording sheet on which the image was fixed.

In these Examples 2–7, the density of the background before reheating was about 0.08.

What is claimed is:

1. Imprinting-transferring type heat-sensitive recording material which comprises a support sheet of 5–40$\mu$ in thickness having thereon a transferable heat-sensitive chromogenic layer comprising a phenolic material, a colorless or pale-colored chromogenic material which reacts with said phenolic material upon application of heat to form color and heat fusible material having a melting point of 40°–150° C. and an image receiving sheet having thereon an image receiving layer containing a receiving agent having tackiness upon application of heat thereon, which is bonded by application of pressure onto the support sheet in such a manner that said heat sensitive chromogenic layer and said image receiving layer are in contact with each other, said heat fusible material being one which (1) increases the sensitivity of the chromogenic material for color formation, (2) bonds the support sheet to the receiving sheet and (3) transfers the heat-imposed portions of the transfer layer.

2. A heat-sensitive recording material according to claim 1, wherein said image receiving sheet is a synthetic paper.

3. A heat-sensitive recording material according to claim 1, wherein the receiving agent is selected from paraffin, micro wax, carnauba wax, synthetic wax, fatty acid amides, polyvinyl chloride, acrylic resin, rosin-modified maleic acid resin, rosin-modified phenol resin and chlorinated rubber.

4. A heat-sensitive recording material according to claim 1 wherein the receiving agent is a polyolefin.

5. A heat-sensitive recording material according to claim 1 wherein the receiving agent is polyethylene wax.

6. A heat-sensitive recording material according to claim 1, wherein a heat-sensitive chromogenic layer which comprises a phenolic material and a colorless or pale-colored chromogenic material which reacts with said phenolic material upon application of heat to form color is provided on the surface of the support sheet opposite to the transferable heat-sensitive chromogenic layer.

7. A heat-sensitive recording material according to claim 1, wherein the support sheet is transparent or translucent.

8. A heat-sensitive recording material according to claim 1, wherein the transferable heat-sensitive chromogenic layer contains the chromogenic material and the phenolic material in such a ratio of the former: the latter of 1:1–10.

9. A heat-sensitive recording material according to claim 1, wherein the amount of the heat fusible material is 30–300% by weight of the phenolic material.

10. A heat sensitive recording material according to claim 1, wherein the transferable heat-sensitive chromogenic layer contains the chromogenic material and the phenolic material in the ratio of the former to the latter of 1:1–10 and wherein the amount of the heat fusible material is 30–300% by weight of the phenolic material.

11. A method for recording images which comprises providing an imprinting-transferring type heat-sensitive recording material which comprises a support sheet of 5–40μ in thickness having thereon a transferable heat-sensitive chromogenic layer comprising a phenolic material, a colorless or pale-colored chromogenic material which reacts with said phenolic material upon application of heat to form color and heat fusible material having a melting point of 40°–150° C. and an image receiving sheet having thereon an image receiving layer containing a receiving agent having tackiness upon application of heat thereon, which is bonded by application of pressure onto the support sheet in such a manner that said heat sensitive chromogenic layer and said image receiving layer are in contact with each other, said heat fusible material being one which (1) increases the sensitivity of the chromogenic material for color formation, (2) bonds the support sheet to the receiving sheet and (3) transfers the heat-imposed portions of the transfer layer, heat-imprinting this recording material and then separating the two sheets to transfer the heat-imprinted images to the image receiving sheet.

* * * * *